US007424905B2

(12) United States Patent
Lai

(10) Patent No.: US 7,424,905 B2
(45) Date of Patent: Sep. 16, 2008

(54) WINDOW BLIND

(76) Inventor: Tony Lai, 19223 E. Colima Rd., #750, Rowland Heights, CA (US) 91748

( * ) Notice: Subject to any disclaimer, the term of this patent is extended or adjusted under 35 U.S.C. 154(b) by 329 days.

(21) Appl. No.: 11/155,390

(22) Filed: Jun. 16, 2005

(65) Prior Publication Data

US 2006/0283560 A1 Dec. 21, 2006

(51) Int. Cl.
*E06B 9/30* (2006.01)
*E06B 9/32* (2006.01)

(52) U.S. Cl. ..... 160/168.1 R; 160/173 R

(58) Field of Classification Search ..... 160/84.01, 160/107, 113, 115, 130, 166.1, 167 R, 168.1 R, 160/170, 172 R, 176.1 P, 176.1 R, 177, 178.2
See application file for complete search history.

(56) References Cited

U.S. PATENT DOCUMENTS 5,934,351 A * 8/1999 Bharucha et al. ..... 160/176.1 R
6,648,048 B2 * 11/2003 Lai ..... 160/115
6,991,020 B1 * 1/2006 Cheng et al. ..... 160/168.1 R
7,100,664 B2 * 9/2006 Hsu ..... 160/115
7,178,576 B2 * 2/2007 Nien et al. ..... 160/168.1 R

* cited by examiner

*Primary Examiner*—Katherine Mitchell
*Assistant Examiner*—Jeremy C Ramsey
(74) *Attorney, Agent, or Firm*—Raymond Y. Chan; David and Raymond Patent Firm

(57) ABSTRACT

A supplement blind enhancement for a window blind includes a plurality of enhancing blades positioned between every two adjacent slats of the window blind, a control system having a control slider, a blade controller extended from the control slider to slidably shift the control slider between a light shading position and a light enhancing position, and an elongated element extended from the control slider to engage with the enhancing blades. At the light shading position, the control slider is driven to slide the enhancing blades suspendedly disposed between the slats in an alternating manner for substantially blocking sunlight passing through a gap between each two slats, and at the light enhancing position, the control slider is driven to slide that each of the enhancing blades to overlap with the respective slat for allowing the sunlight passing through the gap between each two slats.

4 Claims, 6 Drawing Sheets

WINDOW BLIND

BACKGROUND OF THE PRESENT INVENTION

1. Field of Invention

The present invention relates to window blind, more particularly, relates to a lift cord operation system for improving and smoothing out the operation of the window blind so as to provide a diversified shading effect.

2. Description of Related Arts

Blinds and the like such as drapes and portieres are commonly used for sheltering window, separating spaces, and etc., since they are easily maneuverable and aesthetically appealing. Most of the blind comprise a head rail, a bottom rail, a plurality of hanging nets downwardly extended from the head rail to the bottom rail for horizontally and suspendedly supporting a plurality of slats, wherein the slats could be shifted in a vertical movable manner by a lifting mechanism, and individually rotated at the same time.

Here, the lift mechanism is adapted to lift the bottom rail to a desired elevation for selectively allowing the window to be exposed to an exterior thereof. Commonly, the lifting mechanism comprises a plurality of operation cords operated by the user to adjust the elevation or shading status of the window blinds.

Typically, the head rail is a U-shaped elongated channel having a shaft longitudinally provided thereon in for supporting the hanging nets, and at least an opening is cut in the bottom of the U-shaped channel through which the pull cords exited for operating the slats movement.

However, the traditional window blind has several drawbacks. When the slats are upwardly received, sunlight would directly enter the window thus not only heating up the interior of a house but also unpleasing to people's eye. Furthermore, there is no privacy at all because the interior of the house is easily viewed from outside. On the other hand, when the bottom rail is downwardly lowered, sunlight would be shining through from slat gaps. Here, the size of the slat gap is set by the manufacturer so that the user could not make a change. Therefore, user unwillingly has to make a tough decision between privacy and light from predetermined gap. Or helplessly, user might alternatively turn on the light lamp in order to brighten up the interior space.

Based on this situation, an amended window blind, which is capable of providing varying shading effects, have emerged into existence nowadays. This multifunctional window blind comprises an alternation hanging device extended from the head rail for sustaining a predetermined set of the slats, preferably half of the slats, and an alternation-operating lift cord are provided for lifting up the alternation hanging device so as to upwardly move the predetermined set of slats overlapping with remaining slats for doubling the size of the slat gap.

In other words, this kind of window blind system provides two sets of hanging device for simultaneously supporting a set of slats, wherein the ladder-shaped hanging net of the alternation hanging device supports only a predetermined portion of the slats so as to provide a varying shading effect. Every other slat not supported by the alternation hanging device must be adjacent to slats supported by the alternation hanging device.

Accordingly, all top ends of respective elongated hanging nets of the alternation hanging device are merged into a lift cord. Theoretically, by pulling the lift cord, the alternation hanging device could be lifted up to enlarge the slat gap.

For convenient operation, the lift cord is escaped from the head rail and dangling outside to be gripped by the user. The lift cord is adapted to be disposed at one side of the window so as not to block the light shining through the window. Generally, the user could choose a preference as to whether the lift cords and operation cords be disposed on the right side or the left side of the window.

Unfortunately, this lift cord disposed on the side end of the window would impose a cumbersome problem for the user.

For a wider window blind, there are pluralities of ladder-shaped hanging nets spacedly disposed for evenly lifting up the alternation hanging device. However, once the dangling lift cord is pulled, the hanging net positioned at close end to the lift cord would withstand a relatively stronger tension force. Instead, the hanging net disposed at far end with respect to the pulled lift cord would bear a relatively weaker tension force. It is highly unlikely for a user to balancedly lift up the whole alternation hanging device. Most of the time, the alternation hanging device would be lifted up with a tilted angle.

Furthermore, there are several bottom openings spacedly defined at the head rail for exiting the respective hanging net of such alternation hanging device. The lift cords under such a tension would cause a portion of the hanging net repeatedly and reciprocally rub with the head rail body. Even a pulley device could be provided at such openings, there is no guarantee that the hanging net would be passing in and out from the head rail in a smooth manner. In a long run, such an unbalanced tension would cause the lift rod close to the adjacent hanging net worn off or broken.

Moreover, both of the aforementioned lift cord and operation cord utilize cord lifting lock, which is mounted within the head rail, for retaining the lift cord and operation cord in position. Conventionally, the operation cords extend from a bottom rail through the slats and into the head rail. The cords could be collected within the head rail, or more typically, exit one end of the head rail to be dangling outside.

Commonly, the lift lock comprises a lock housing integrally defined within the head rail, a stationary roller journalled in the housing, and a floating gear wheel disposed moveably in the housing from an unlocked position to a locked position, wherein the lift cord is sliding between the stationary roller and the floating gear wheel for moving the floating gear wheel from the unlocked position to the locked position, in the unlocked position, the lift cord could be slide over the floating gear wheel to permit lifting and lowering of the slats, and in the locked position, the floating gear wheel is clamped between the stationary roller and the housing so that the lift cord is stuck between the floating gear wheel and the stationary roller.

Unfortunately, once the lift lock is utilized to lock the lifted alternation hanging device, the lift lock would withstand overall weight of the alternation hanging device, the floating gear wheel would be released a little bit for biasing against the lift cord. For conventional operation cords, the homing movement of the floating gear wheel could ensure the operation rod securely stuck between the stationary roller and the floating gear wheel. However, for the alternation hanging device, which is adapted to lift up half of the slats tightly overlapped with remaining half of the slats for enlarging the slat gap. This homing release would be undesirable even intolerable to most users. This is due to the fact that the homing movement of the floating gear wheel would lower the predetermined set of the slats supported by the alternation hanging device away from the remaining slats thus ruining the shading effect.

SUMMARY OF THE PRESENT INVENTION

A primary object of the present invention is to provide a lift cord operation system for a window blind having an alternation hanging device to provide diversified shading effects, wherein the alternation hanging device could be lift up in balanced manner by the dangling life cord disposed at one end of the window blind.

Another object of the present invention is to provide a lift cord operation system for a window blind having an alternation hanging device to provide diversified shading effects, wherein each of the hanging net of the alternation hanging device would be evenly bearing a tension once the lift cord is pulled by a user.

Another object of the present invention is to provide a lift cord operation system for a window blind having an alternation hanging device to provide diversified shading effects, wherein the relative position between neighboring hanging net are maintained with a fixed distance while the lift cord of the alternation hanging device is operated.

Another object of the present invention is to provide a lift cord operation system for a window blind having an alternation hanging device to provide diversified shading effects, wherein once the lift cord is pulled lifting up the alternation hanging device, the floating gear wheel of the lift lock would not be homed back to define an undesirable shading effect.

Accordingly, to achieve the above objects, the present invention provides a window blind, comprising:

a top support adapted for supporting at a window ceiling;

a bottom support spacedly disposed underneath the top support;

a plurality of slats spacedly disposed between the top and bottom support;

a folding unit comprising a pulley system supported by the top support and an elongated cord having a lifting portion extended from the top support to engage with the pulley system and a folding portion extended from the top support to the bottom support to suspendedly support the slats in such a manner that when the lifting portion of the elongated cord is pulled from the top support, the bottom support is lifted up towards the top support to overlap with the slats between the top and bottom supports; and a supplement blind enhancement, which comprises:

a plurality of enhancing blades disposed between the top and bottom supports, wherein each of the enhancing blades is positioned between every two adjacent the slats;

a control system comprising a control slider slidably mounted at the top support, a blade controller extended from the control slider to slidably shift the control enhancing blades between a light shading position and a light enhancing position, and two elongated elements extended from the control slider to engage with two end portions of each of the enhancing blades respectively, wherein at the light shading position, the control slider is driven to slide that the enhancing blades are suspendedly disposed between the slats in an alternating manner for substantially blocking sunlight passing through a gap between each two the slats, and at the light enhancing position, the control slider is driven to slide that each of the enhancing blades to overlap with the respective slat for allowing the sunlight passing through the gap between each to the slats.

These and other objectives, features, and advantages of the present invention will become apparent from the following detailed description, the accompanying drawings, and the appended claims.

DETAILED DESCRIPTION OF THE PREFERRED EMBODIMENT

Figure 1:
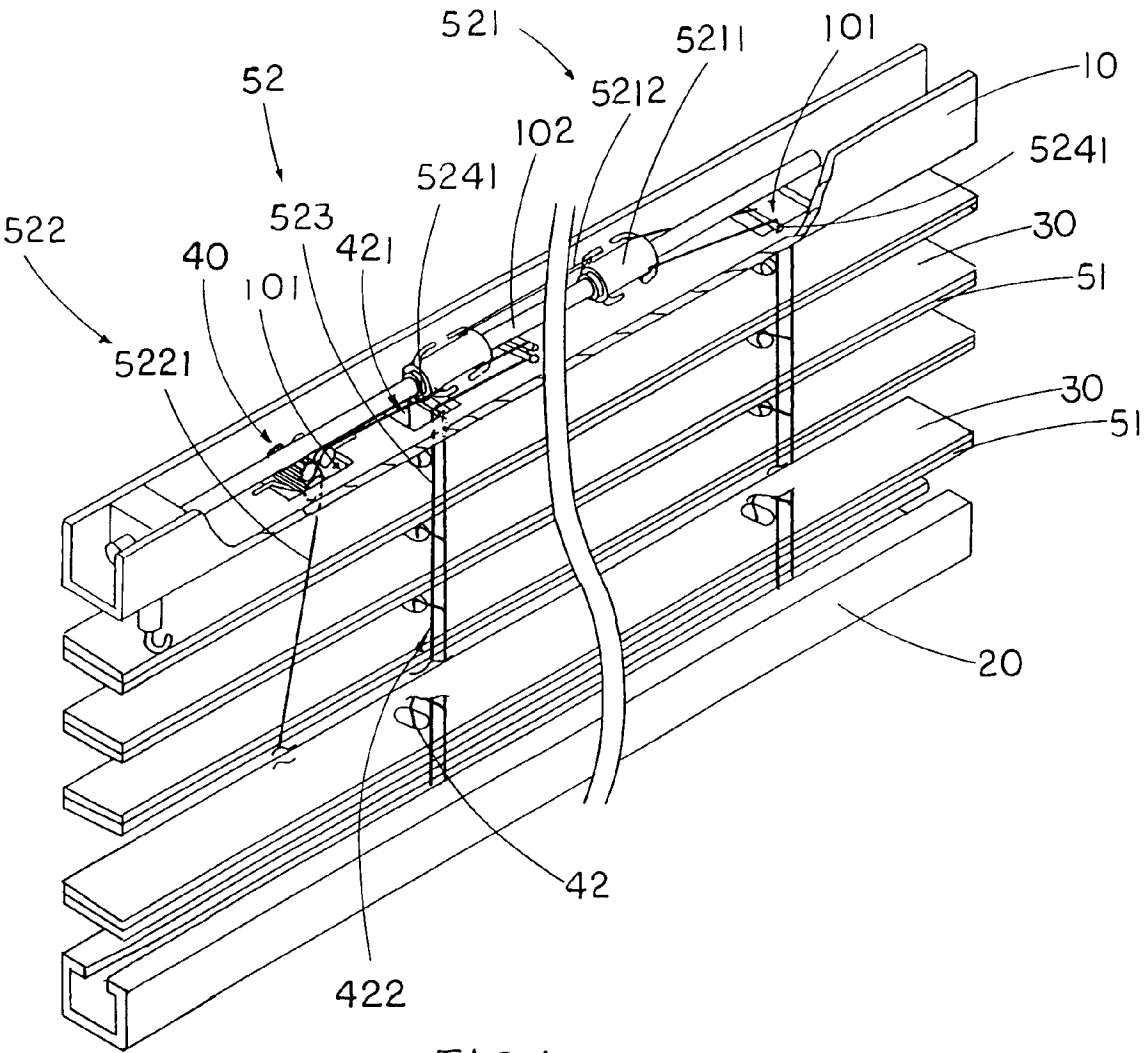
FIG. 1 is a perspective view of the window blind of the preferred embodiment of the present invention, showing the enhancing blades is operated by the control system so as to overlap with adjacent slats to define an enlarged shading status.

Referring to FIG. 1, a window blind according to the preferred embodiment of the present invention is illustrated. The window blind 1 comprises a top support 10 adapted for supporting at a window ceiling, a bottom support 20 spacedly disposed underneath the top support 10, and a plurality of slats 30 spacedly disposed between the top support 10 and the bottom support 20.

Furthermore, the window blind 1 comprises a folding unit 40 comprising a pulley system 41 supported by the top support 10 and an elongated cord 42 having a lifting portion 421 extended from the top support 10 to engage with the pulley system 41 and a folding portion 422 extended from the top support 10 to the bottom support 20 to suspendedly support the slats 30 in such a manner that when the lifting portion 421 of the elongated cord 42 is pulled from the top support 10, the bottom support 20 is lifted up towards the top support 10 to overlap with the slats 30 between the top and bottom supports 10, 20.

In the present invention, the window blind 1 further comprises a supplement blind enhancement 50, which comprises a plurality of enhancing blades 51 suspendedly disposed between the top support 10 and the bottom support 20, wherein each of the enhancing blades 51 is positioned between every two adjacent slats 30, a control system 52 comprising a control slider 521 slidably mounted at the top support 10, a blade controller 522 extended from the control slider 521 to slidably shift the control slider 521 between a light shading position and a light enhancing position, and two elongated elements 523 extended from the control slider 521 to engage with two end portions of each of the enhancing blades 51 respectively, It is noted wherein at the light shading position, the control slider 521 is driven to slide for defining the enhancing blades 51 suspendedly disposed between the slats 30 in an alternating manner for substantially blocking sunlight passing through a gap between each two slats 30, and at the light enhancing position, the control slider is driven to slide permitting that each of the enhancing blades 51 to overlap with the respective slat 30 for allowing the sunlight passing through the gap between each two slats 30.

Here, the supplement blind enhancement 50 is adapted to facilitate the conventional blind to generate a diversified shading status. Generically, the plurality of slats 30 are individually and suspendedly sustained by ladder-shaped hanging nets disposed between the top support 10 and the bottom support 20. To provide a convenient and efficient operation and delighted varying shading status, the window blind 1 of the present invention provides a set of enhancing blades 51 respectively sandwiched between every neighboring pair of neighboring slats 30, wherein the enhancing blades 51 could be lifted up through the elongated element 523 to overlap with respective slats 30 for enlarging the slat gap.

Preferably, the slats 30 and the enhancing blades 51 are identically made of same size and shape. That is to say, the slats 30 and the enhancing blades 51 are well supported by ladder-shaped hanging nets. The enhancing blades 51 are just a set of the slats 30 alternatively operated by the control system 52 for improving the shading status.

Or otherwise, the control system 52 could be considered as an alternation hanging device purposed for assigning the conventional hanging nets of the window blind 1 to simultaneously sustain a predetermined set of slats 30, preferably, half set of the slats 30. As a result, once the elongated element 532 is vertically shifted, half set of the slats 30, i.e. the enhancing blades 51, would be upwardly or downwardly overlapping with adjacent slats 30 for adjusting the slat gap of the window.

According to the present invention, the top support 10 is embodied as an elongated U-shaped head rail, having a plurality of bottom openings 101 for passing through the hanging nets of the slats 30 and the elongate element 523. Preferably, for a common window blind, the elongated element 523 are embodied as two ladder-shaped hanging devices downwardly extended from the top support 10. It is noted for some special slats, such as slats made of wood or epoxy plastics, only one centrally disposed elongated element 523 would be sufficient for accomplishing such shifting movement.

The elongated U-shaped top support 10 is a conventional head rail used for most Venetian window blind, and is affixed to the ceiling or an upper portion of the window. The plurality of bottom openings 101 are cut at the elongated U-shaped top support 10 for correspondingly accommodating the elongated elements 523 of the control system 52.

Figure 2:
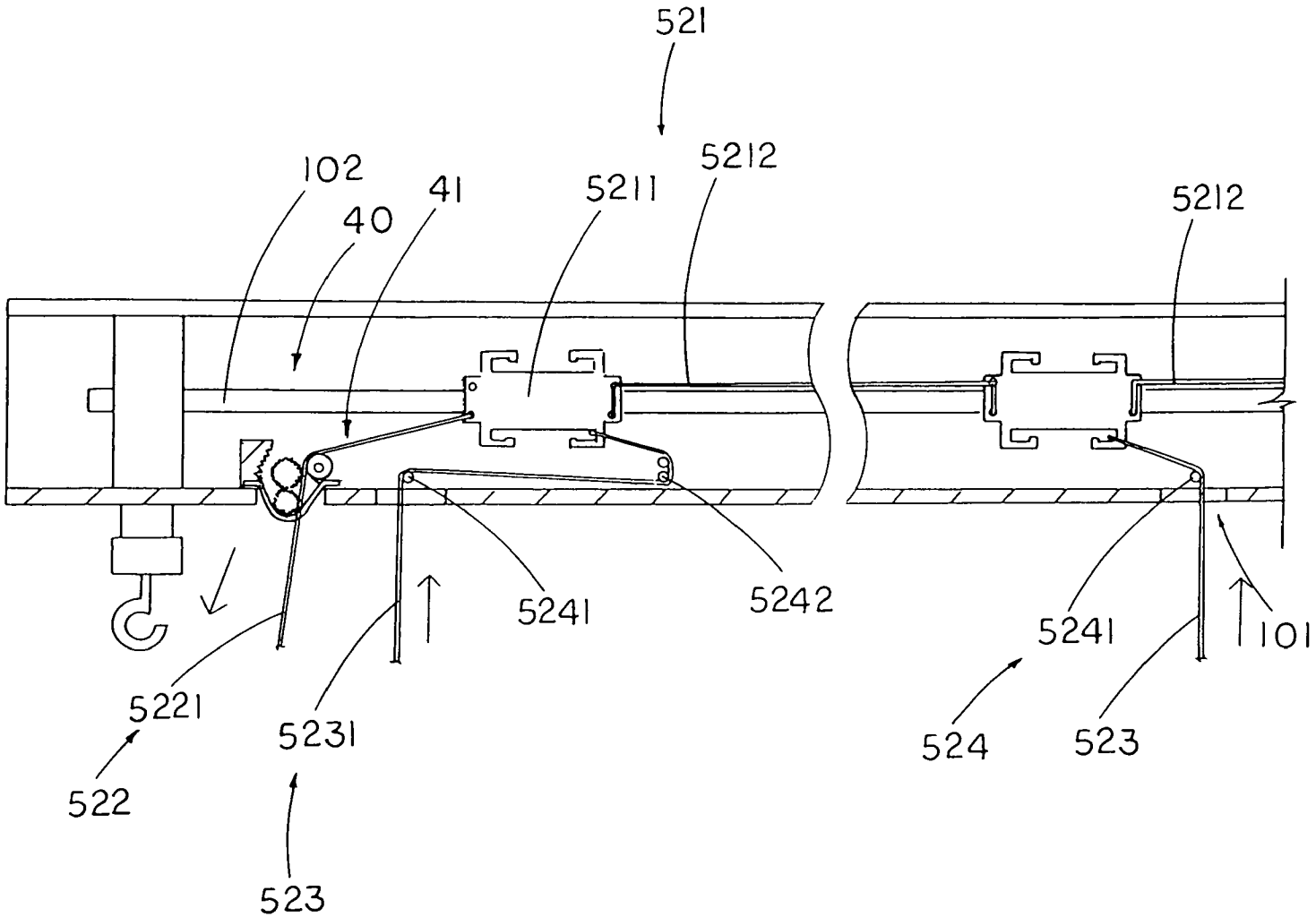
FIG. 2 is a schematic view of above control system of preferred embodiment of the present invention illustrating the hanging nets of the elongated elements are penetrating through the bottom opening of the top support via the sliding pars, and respectively coupled to the control slider, and a positioning par disposed at a position close to one corner of the window blind, so that the first hanging net of the elongated element is detoured to bypass such positioning bar to achieve a desirable torque.

As shown in FIG. 2, an axial shaft 102 is rotatably received in the U-shaped top support 10, wherein the control slider 521 is slidably mounted at the axial shaft 102. In the preferred embodiment, the control slider 521, comprises a pair of tackles 5211 spacedly and slidably mounted onto the axial shaft 102, and a reinforcement bar 5212 disposed between two tackles 5211 for coupling two tackles 5211. This is due to the fact that the elongated element 523 comprises at least two hanging nets respective disposed at two side of the window blind, so that a prolonged control slider 521 would provide an effective torque force. That is to say, each of two hanging nets of the elongated element 523 is respectively is coupled to adjacent tackle 5211 in position, the prolonged control slider 521 enable two hanging nets disposed in a relatively parallel manner.

It is worth to mention that for a wider screen window, the elongated element 523 could comprise a plurality of hanging nets for sustaining the enhancing blades 51 in a balanced manner. Therefore, the control slider 521 would comprise a plurality of tackles 5211 spacedly disposed in a series manner. Accordingly, there would be correspondingly a plurality of reinforcement bars 5212 provided for interconnecting the plurality of tackles 5211 together.

The control system 52 further comprises a distributing system 524 comprising a plurality of sliding bars 5241 transversely provided at each of the bottom openings 101 of the top support 10, wherein the elongated element 523 are slidably passing through the sliding bars 132 to achieve a friction-free movement.

According to the preferred embodiment of the present invention, the blade controller 522 of the control system 52 is embodied as a lift cord 5221, which is coupled to one end of the control slider 521 for moving the control slider 521 along the axial shaft 102, so that once lift cord 5221 is pulled, the control slider 521 is capable of straightening and forcing the elongated element 523 slide along the sliding bars 132 so as to lift up or lower down the enhancing blades 51 in a smooth manner.

Referring to FIG. 2, the tackles 5211 of the control slider 521 are rotatably and slidably mounted to the axial shaft 102 for correspondingly mating the hanging nets of the elongated element 523. In the present invention, the quantity of tackles 5211 is equal to the hanging nets of the elongated element 523. That is to say, for a common window blind wherein the elongated element 523 has only two hanging nets, the control slider 521 has two tackles 5211 for accommodatedly coupling respective hanging net. For a wider screen window, there are a series of tackles 5211 provided for coupling different hanging nets of the elongated element 523.

The reinforcement bar 5212 is adapted to ensure the control slider defined as an integral part. As shown in FIG. 2, the tackles 5211 of the control slider 521 are sleeved onto the axial shaft 102. In the present invention, the distributing system 524 is adapted to smooth out the frictional movement of the elongated element 523.

According to the present invention, each of the hanging nets of the elongated element 523 is adapted to be attached onto the corresponding tackle 5211 of the control slider 521. Basically, the bottom openings 101 of the top support 10 are aligned with the hanging nets of the elongated element 523, so that the hanging nets of the elongated element 523 could be easily penetrating through the bottom opening 101 of the top support 10.

However, the control slider 521 of the present invention is not long enough to ensure that tackles 5211 are individually and vertically aligned with the bottom openings 101 as well as the hanging net 30. Once the control slider 521 is shifted along the axial shaft 102, it is inevitable that the elongated element 523 would laterally be shifted to be rubbed with the edge of the bottom opening 101. The sliding bars 5241 of the distributing system 524 are arranged to overcome the rubbing force. Here, each of the sliding bars 5241 is embodied as steel pins spanning cross on the bottom openings 101, so that once the control slider 521 is shifted, the upwardly proceeding elongated element 523 would be sliding along the relative slick steel pin.

To guarantee a smooth operation of the control system 52, the distributing system 524 further comprises a positioning bar 5242 transversely spanned across two side walls of elongate U-shaped top support 10 at a position close to the control slider 521, so that the first hanging net of the elongated element 523 could be detoured bypassing such positioning bars 5242 to achieve a desirable torque force for lifting up the enhancing blades 51.

Figure 4:
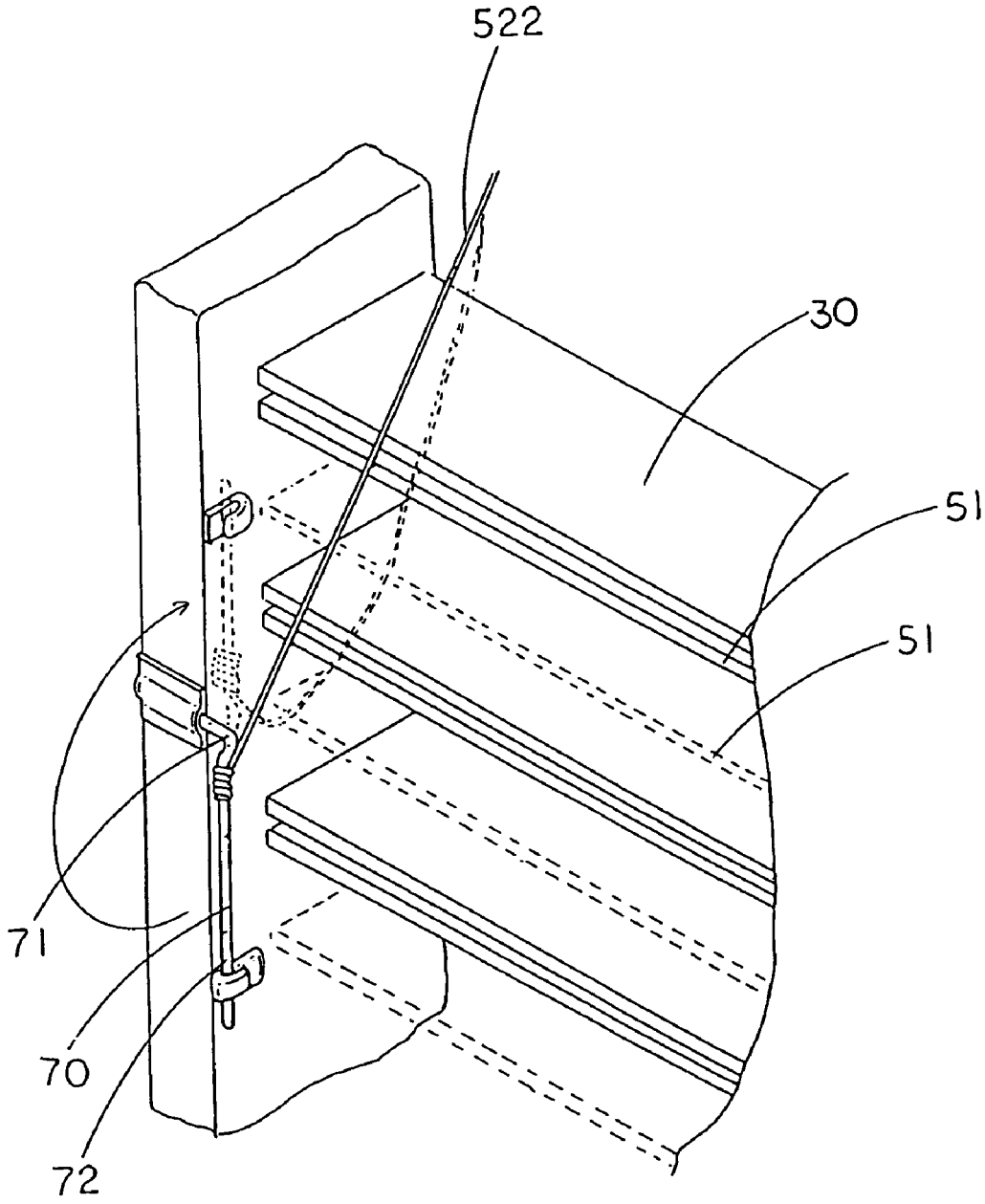
FIG. 4 shows an alternative mode of the above locking arrangement showing a positioning lever is provided at the lower end of the lift cord for locking the control slider in a light shading position.

The control slider 521 is disposed at one side of the window blind for simple installation and convenient operation. This is due to the fact that blade controller 522 is extended from the control slider 521 for adjusting the shading status. As shown in FIG. 4, the control slider 521 is disposed at a position close to the left corner of the window blind, and there are three hanging nets 5231 of the elongated element 523 coupled to the control slider 521. It is highly unlikely that the laterally shifting control slider 521 could provide an efficient torque towards the first hanging net 5231, since the first hanging net 5231 is disposed immediately beneath the control slider 521. Therefore, to convert such a lateral kinetic energy into a potential energy of the first hanging net 5231, the present invention provides the positioning bar 5242 wherein the first hanging net 5231 could be detoured bypassing such positioning bar for achieving a desirable torque. After such detouring procedure, all three hanging nets of the elongated element 523 are radially extended from the control slider 521.

As shown in FIG. 2, the first hanging nets of elongated element 523 disposed at the left side is detoured to bypass a positioning bar 5242, so that once the control slider 521 is shifted leftward, the upper portion of hanging nets 5231 could be tightened up in a relatively parallel manner. The first hanging net disposed adjacent to the control slider 521 is detoured to pass the positioning bar 5242 and then extend backward to pass the sliding bar 5241 defined at the bottom opening 101 so as to provide an optimal torque for lifting up the enhancing blades 51.

That is to say, once the control slider 521 is laterally shifted by the blade controller 522, the tackles 5211 of the control slider 521 would carry respective hanging nets of the elongated element 523 into movement. It is worth to mention that the hanging net could be detoured regarding to the location of the control slider 521. In case the control slider 521 is provided at the other side of the window blind, the elongated element would be detoured from a reversed direction.

The blade controller 522 of the present invention further comprises a locking arrangement 5221 for locking the control slider 521 in a light enhancing position so as to prevent the shifted enhanced blades 51 overlapped with the slats 30 from homing to original position to affect the enlarged slat gaps.

Figure 3:
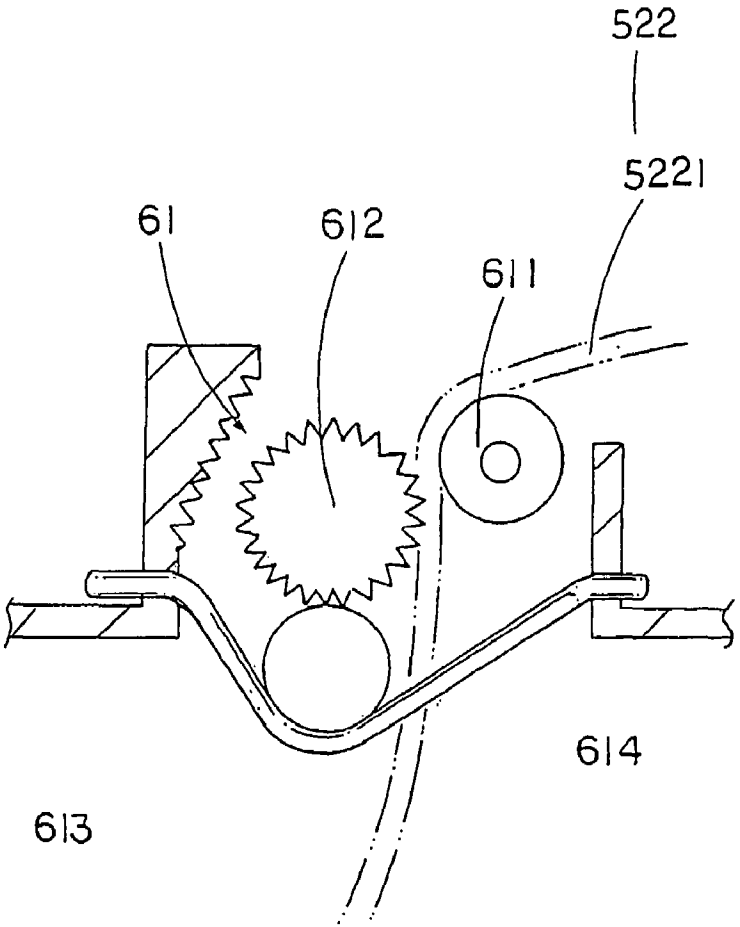
FIG. 3 is a perspective view of the locking arrangement according to the preferred embodiment of the present invention, illustrating the retaining gear is disposed underneath the floating gear wheel for preventing the floating lift lock from being homed downwardly so as to ensure the control slider maintained at a light enhancing position.

As shown in FIG. 3, the blade controller 522 of the present invention is embodied as conventional lift cord coupled to the control slider 521. For collecting the lift cord within the top support 10, there is a locking housing 61 integrally defined at the top support 10 so as to generate an operational space, wherein a stationary roller 611 is jounalled within the housing 61, a floating gear 612 is disposed moveably with respect to the stationary roller 611, and a lower bracket 613 is provided for sustaining the stationary roller 611 and the floating gear 612 in position. The lift cord passing through the stationary roller 611 and the floating gear 612 is capable of shoving the floating gear 612 shifted from an unlocked position to a locked position. As a result, after the lift cord is pulled by a user to adjust the enhancing blades 51, the floating gear 612 is able to tightly biasing against the stationary roller 611 so as to sandwich the lift cord 60, and more importantly, block the lift cord 60 from being loosened up to ruin the shading status.

Preferably, the lower bracket 613 is curve shaped exploring the operational space, and the blade controller 522 comprises a blocking roller 614 disposed between the floating gear 612 and the lower bracket 613 for preventing the floating gear 612 from homing downwardly.

As shown in FIG. 3, the blocking roller 614 is adapted to be stuffed into a space defined between the floating gear 612 and the lower bracket 613. That is to say, after the floating gear is shoved upwardly from the unlocked position to the locked position, the blocking roller 613 would also be upwardly delivered so as to prevent the floating gear from a home movement.

As a result, in the unlocked position, the lift cord could be slide over the floating gear 612 for controlling the lifting and lowering movement of the slats 30, and in the locked position, the floating gear 612 is clamped between the stationary roller 611 and the lock housing 61, and is well sustained by the lower bracket 613, so that the lift cord 60 is stuck between the floating gear 612 and the stationary roller 611.

Or otherwise, as shown in FIG. 4, the free end of the lift cord 5221 of the blade controller 522 is fastened to a locking lever 70 which is mounted to side frame of the window. The locking lever 70 has a fixing end 71 securely mounted to the side frame of the window, and a free end 72 pivotally moveable with respect to the fixing end 72, wherein the lift cord of the blade controller 522 is fastened to the locking lever 70 in a position having a predetermined distance away from the fixing end 71, so that when the free end 72 of the locking lever 70 is downwardly and pivotally moved with respect to the window frame, the lift cord 5221 is capable of being downwardly shifted so as to pull the control slider 521 into a lateral movement for adjusting the shading status.

Figure 5:
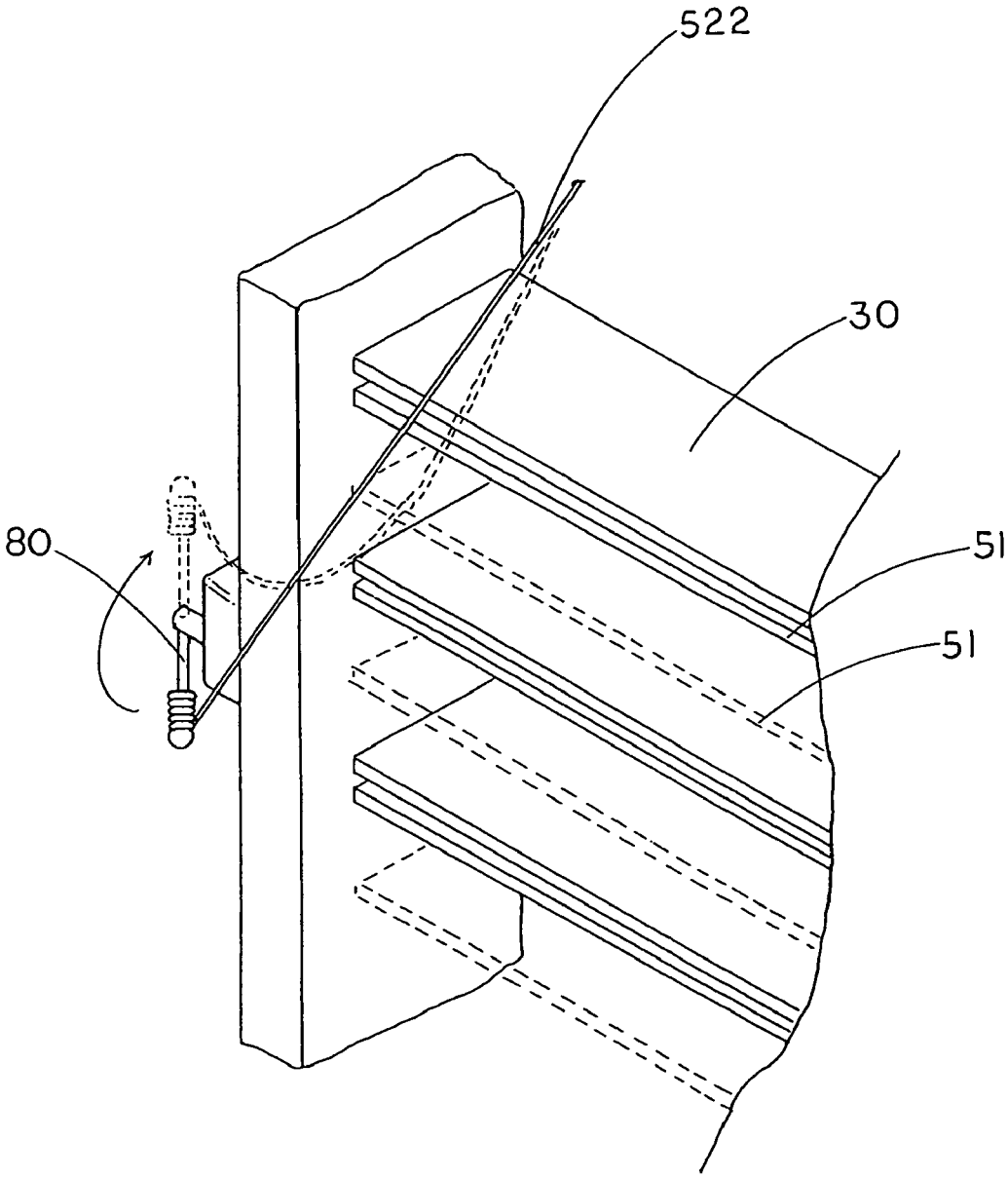
FIG. 5 shows another alternative mode of the above locking arrangement showing an electrically driven motor is provided for effectively facilitating the lateral movement of the control slider.

Or otherwise, as shown in FIG. 5, the free end of the lift cord 5221 of the blade controller 522 is directly mounted to a motor driven rocking lever 80, moving pivotally along a set of radial stages, wherein the rocking lever 80 is directly fastened to the side frame of the window, so that when the rocking lever 80 is powered by an electrical motor to pivotally and circularly shifted along the perimeter, the lift cord 5221 would be downwardly tighten up for ultimately shifting the control slider 521 into a movement adjusting the shading position.

Figure 6:
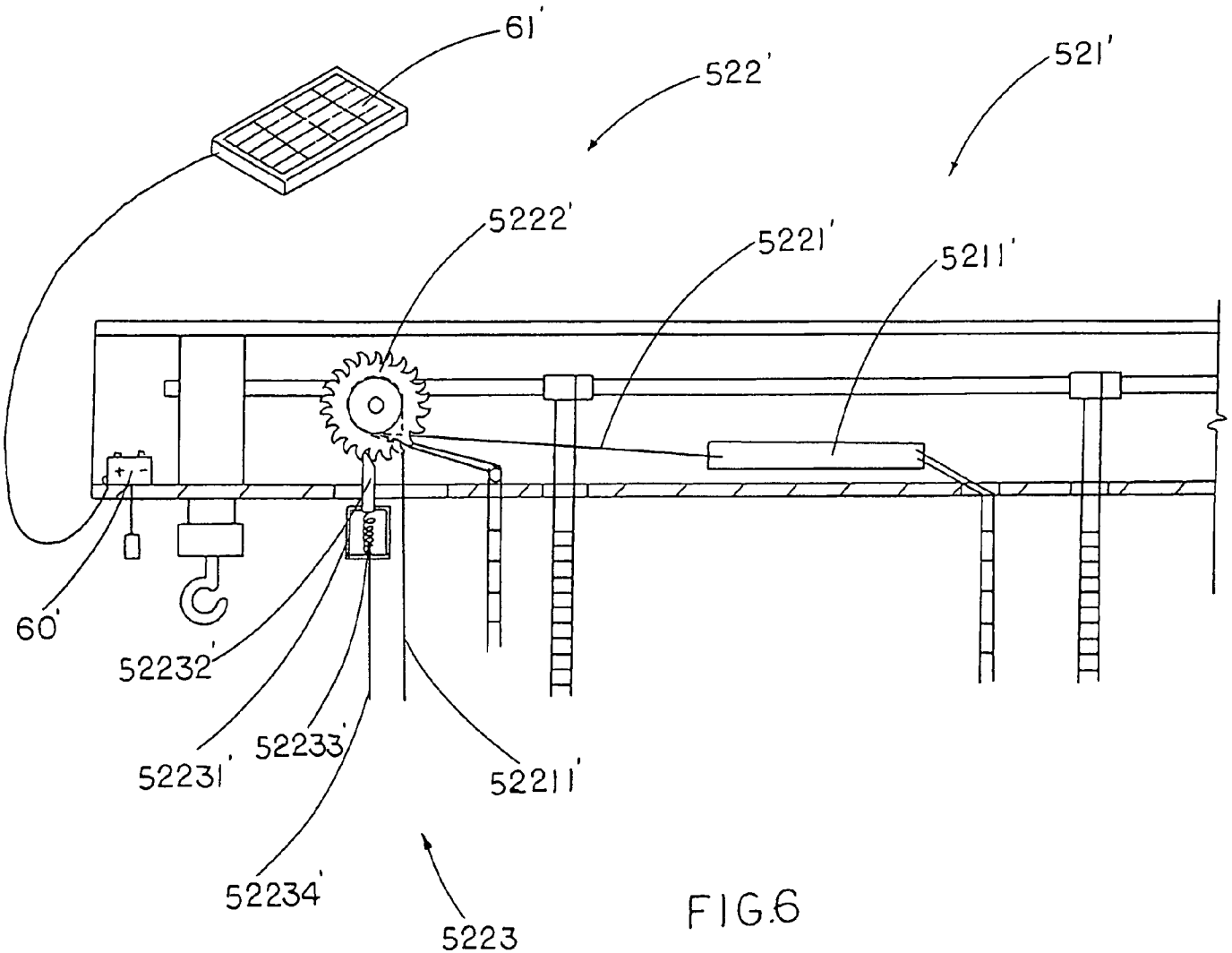
FIG. 6 is a schematic view of the window blind according to a second preferred embodiment of the present invention.

Referring to FIG. 6, the window blind according to the second preferred embodiment of the present invention is illustrated. The control slider 521' is defined as a sliding block 5211' slidably disposed at the elongated U-shaped top support 10', the blade controller 522' comprises a unidirectional gear wheel 5222' supported by the top support 10' and laterally disposed with respect to the control slider 521', wherein the lift cord 5221' is extended from one side of the control slider 521' and is reeled onto the axis of gear wheel 5222'.

It is noted that the lift cord 5221' has a free end 52211' freely accessible to the user, so that a user could pull such free end 52211' for driving the unidirectional gear wheel into rotation so as to force the sliding block 5211' shift laterally along the top support 10', thus lifting up the enhancing blade to change the shading status. Here, the blade controller 522' further comprises a rotation stopper 5223' disposed below the unidirectional gear wheel 5222' for limiting the unidirectional gear wheel 5222' from being rotated in a reversed dirction. The rotation stopper 5223' comprises a stopper housing 52231' supported by the top support 10', and a retractable probe 52232' resiliently projected from the stopper housing for engaging with the teeth of the unidirectional gear wheel 5222', wherein a resilient member 52233' is disposed within the stopper housing 52231' for biasing the retractable probe 52232' projected upwardly, and a release cord 52234' coupled to the resilient member 52233' for disabling the biasing force between the resilient member 52233' and the retractable probe 52232'.

As shown in FIG. 6, the teeth of the unidirectional gear wheel 5222' is identically curve-shaped, each of the teeth has a curved sliding side and a stopping side. Correspondingly, the retractable probe 52232' is triangle shaped having a vertical plane and an inclined plane. Each of the sliding side of the teeth will be subsequently engage with the inclined plane of the retractable probe 52232' whenever the user pull the free end of the lift cord 5221'. However, the vertical plane of the retractable probe 52232' would prevent the unidirectional gear wheel from rotating in reversed direction. That is to say, a user is able to pull down the free end 52211' to lift up the enhancing blade 51 to and an inclined plane. Each of the sliding side of the teeth will be subsequently engage with the inclined plane of the retractable probe 52232' whenever the user pull the free end of the lift cord 5221'. However, the vertical plane of the retractable probe 52232' would prevent the unidirectional gear wheel from rotating in reversed direction. That is to say, a user is able to pull down the free end 52211' to lift up the enhancing blade 51 to change the shading status, as the unidirectional gear wheel rotated, the retractable probe 52232' would automatically and constantly securing the unidirectional gear wheel in position so as hold the shading status unchanged. On the other hand, to return the original shading status, the user has to pull the release cord 52234' to unlock the retractable probe 52232' from the unidirectional gear wheel 5222' allowing the unidirectional gear wheel rotated by the weight of the enhancing blade system.

As shown in FIG. 6, the above mentioned unidirectional gear wheel 5222' is driven by an electrical motor 60' provided at the top support 10', wherein a switch is defined on such motor for managing the unidirectional gear wheel 5222' rotating in a clockwise or a counter-clockwise manner. furthermore, since the window blinds are supposed provided to the window to block the strong sun expose, a solar panel 61' could be installed to an outside of such window blind for charging the driven motor with an environment-friendly manner.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A window blind, comprising:

a top support adapted for supporting at a window ceiling;

a bottom support spacedly disposed underneath said top support;

a plurality of slats spacedly disposed between said top and bottom support;

a folding unit comprising a pulley system supported by said top support and an elongated cord having a lifting portion extended from said top support to engage with said pulley system and a folding portion extended from said top support to said bottom support to suspendedly support said slats in such a manner that when said lifting portion of said elongated cord is pulled from said top support, said bottom support is lifted up towards said top support to overlap with said slats between said top and bottom supports; and a supplement blind enhancement, which comprises:

a plurality of enhancing blades disposed between said top and bottom supports, wherein each of said enhancing blades is positioned between every two adjacent said slats;

a control system comprising a control slider slidably mounted at said top support, a blade controller extended from said control slider to slidably shift said control enhancing blades between a light shading position and a light enhancing position, and two elongated elements extended from said control slider to engage with two end portions of each of said enhancing blades respectively, wherein at said light shading position, said control slider is driven to slide that said enhancing blades are suspendedly disposed between said slats in an alternating manner for substantially blocking sunlight passing through a gap between each two said slats, and at said light enhancing position, said control slider is driven to slide that each of said enhancing blades to overlap with said respective slat for allowing said sunlight passing through said gap between each to said slats, wherein said control slider comprises two tackles spacedly and slidably mounted at said top support to connect with said elongated elements respectively such that when said blade controller drives said two tackles to slide along said top support at one direction, said enhancing blades are overlapped with said slats for allowing said sunlight passing through said gaps between said slats, and when said blade controller drives said two tackles to slide along said top support at an opposed direction, said enhancing blades are suspendedly disposed between said slats for substantially blocking sunlight passing through said gap between two said slats, and wherein said top support comprises an axial shaft extending longitudinally that said two tackles are guided to slide along said axial shaft to move said control enhancing blades between said light shading position and said light enhancing position.

2. The window blind, as recited in claim 1, wherein said control slider further comprises a reinforcement arm extended between said two tackles to retain said two tackles at a predetermined distance such that said blade controller drives said two tackles to slide on said top support in a synchronizing manner.

3. The window blind, as recited in claim 2, further comprising a distributing system comprising a plurality of sliding pins transversely and spacedly provided at said top support, wherein said sliding pins guide said elongated elements to connect with said blade controller for minimizing a friction force of each of said elongated element when said elongated element slides on said sliding pins.

4. The window blind, as recited in claim 3, wherein said blade controller comprises a lift cord having an affixing end extended from said control slider and an opposed free end which is extended out of said top support and is arranged in such a manner that when said lift cord is pulled away from said top support, each of said enhancing blades is lifted up to overlap underneath said respective slat for allowing said sunlight passing through said gap between each to said slats.

* * * * *